US005236374A

United States Patent [19]

Leonard et al.

[11] Patent Number: 5,236,374

[45] Date of Patent: Aug. 17, 1993

[54] EXTENSION CORD WITH MULTIPLE RECEPTACLES

[76] Inventors: Thomas R. Leonard, 947 Calle Los Aceitunos, Camarillo, Calif. 93010; Edward J. Munson, 1011 Grand Canyon, Brea, Calif. 92621

[21] Appl. No.: 929,309

[22] Filed: Aug. 13, 1992

[51] Int. Cl.[5] ..... H01R 11/00

[52] U.S. Cl. ..... 439/505; 439/621; 439/650

[58] Field of Search ..... 439/502, 505, 621, 622, 439/650

[56] References Cited

U.S. PATENT DOCUMENTS

| | | | |
|---|---|---|---|
| 2,201,045 | 5/1940 | Lundstrom | 439/505 |
| 2,468,773 | 5/1949 | Musinski | 439/505 |
| 2,533,222 | 12/1950 | Cohen | 439/505 |
| 4,099,824 | 7/1978 | Schoppelrey | 439/505 |
| 4,717,350 | 1/1988 | Lax | 439/650 |
| 4,764,128 | 8/1988 | Cheng | 439/505 |
| 4,834,664 | 5/1989 | Lin | 439/621 |

FOREIGN PATENT DOCUMENTS

| | | | |
|---|---|---|---|
| 90/07207 | 6/1990 | World Int. Prop. O. | 439/505 |

*Primary Examiner*—Paula A. Bradley
*Attorney, Agent, or Firm*—Collard & Roe

[57] ABSTRACT

An extension cord with multiple receptacles having an electric wire with a first end, a second end, and a male plug coupled to the first end and a method for forming same. A fuse is coupled to the wire. Multiple receptacle blocks are coupled to the wire at spaced intervals along the wire. One of the receptacle blocks is coupled to the second end of the wire. Each of the receptacle blocks has several pairs of slots for receiving male plugs of items to be powered by the extension cord.

11 Claims, 3 Drawing Sheets

EXTENSION CORD WITH MULTIPLE RECEPTACLES

BACKGROUND OF THE INVENTION

1. Field of the Invention

The present invention relates to an extension cord with multiple receptacle blocks for use with miniature Christmas lights, and a method for forming same. More specifically, it relates to an extension cord having receptacle blocks coupled to a wire at spaced intervals with each receptacle block having several pairs of slots for receiving male plugs.

2. The Prior Art

Extension cords are known to place a power source at a convenient location. The known extension cords typically have a single male plug for coupling to a wall receptacle. The male plug is connected by a wire of variable length and gauge to a female receptacle. The female receptacle typically contains one, two or three pairs of slots for receiving male plugs of items to be powered by the extension cord.

A drawback exists in the prior art extension cords in that all of the female portions of the plug are located in one receptacle block. If receptacles are needed at spaced intervals, then a second extension cord is required which is either plugged into the wall receptacle or plugged into one of the receptacles on the first extension cord. Coupling two extension cords together has drawbacks in that one receptacle on the first extension cord is used and coupling cords of different ratings may present a safety risk. Also, either method provides additional wire which is unsightly and unsafe due to excess wire lying on the ground.

SUMMARY OF THE INVENTION

It is therefore an object of the present invention to provide an extension cord which overcomes the drawbacks of the prior art and provides multiple receptacle blocks at spaced intervals along the extension cord.

It is a further object of the present invention to provide an extension cord which is safe to use.

It is still another object of the present invention to provide a method for forming a receptacle block.

These and other related objects are achieved according to the invention by an extension cord with multiple receptacle blocks having an electric wire with a first end, a second end and a male plug coupled to said first end thereof. A fuse is coupled to the wire in addition to multiple receptacle blocks that are coupled to the wire at spaced intervals. One of the receptacle blocks is coupled to the second end of the wire. Each of the receptacle blocks has several pairs of slots for receiving male plugs of items to be powered by the extension cord.

The extension cord is provided with a fuse to prevent excessive current from passing through the wire. The fuse has a rating sufficiently high to accommodate several strings of miniature Christmas lights.

The method for forming a receptacle block according to the invention includes providing an incoming wire and an outgoing wire. The wires are crimped together by a terminal having a crimp connector. A receptacle block is molded around the wires and terminal with pairs of slots present in the block for receiving a plug to contact the terminal.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENT

Figure 1:
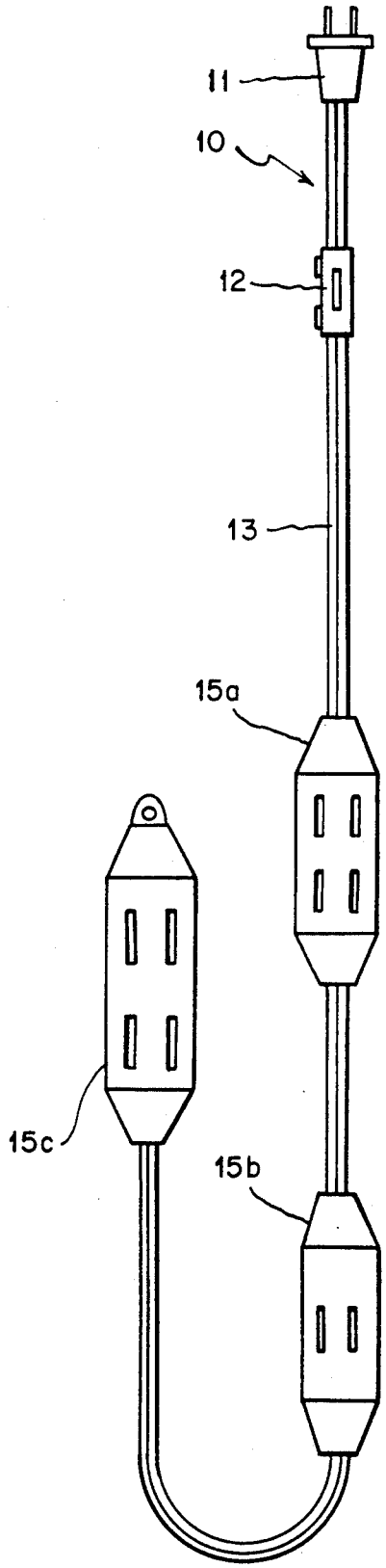
FIG. 1 is a top plan view of the extension cord according to the invention.

Referring now in detail to the drawings and, in particular, to FIG. 1, there is shown an extension cord 10 having a male plug 11 attached to one end thereof and a fuse, for example, an in-line fuse 12 coupled to a wire 13. Wire 13 is, for example, an 18-gauge two conductor wire (18/2 AWG, SPT-2, nonshielded flexible cord) having in-line fuse 12 coupled to one of the conductors with a current rating of 6 amps, for example. In-line fuse 12 is located six inches from plug 11, for example. If a polarized plug 11 is used, then in-line fuse 12 would be coupled to the hot lead of wire 13, otherwise fuse 12 could be coupled to either conductor. Receptacle blocks 15*a*, 15*b* and 15*c* are coupled to wire 13 at spaced intervals. Receptacle block 15*c* is located at the end of wire 13 opposite male plug 11. Receptacle blocks 15*a*, 15*b* and 15*c* each contain three pairs of slots, for example, two pairs of slots on one side (see block 15*a*), and one pair of slots on the other side (see block 15*b*). Fuse 12 may also be located within male plug 11 or receptacle blocks 15*a*, 15*b* or 15*c*.

Figure 2:
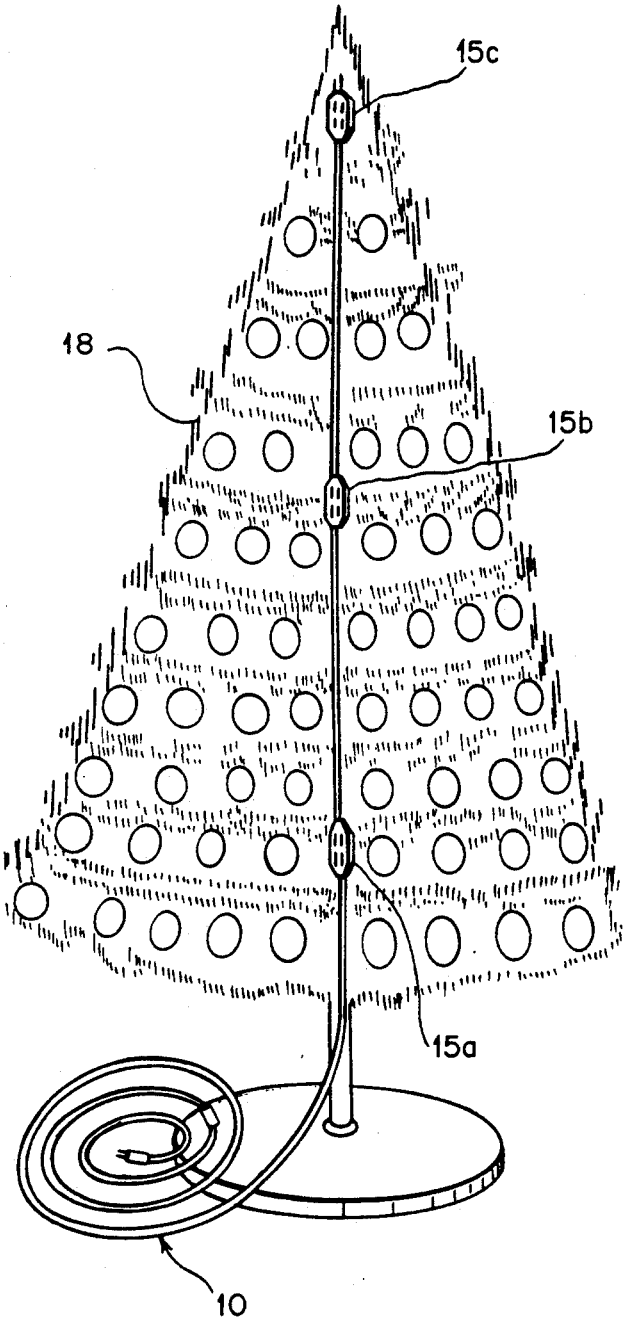
FIG. 2 is a side elevational view of the extension cord placed on a Christmas tree.

As can be seen in FIG. 2, receptacle blocks 15*a*, 15*b* and 15*c* are spaced along wire 13 to provide one receptacle block at the bottom, middle and top of a Christmas tree 18, for example. Eighteen inches of wire 13 is provided between receptacle blocks, for example. This arrangement allows Christmas lights at the bottom, middle or top of Christmas tree 18 to each have their own receptacle block. In addition, receptacle block 15*c* can conveniently receive the male plug of an ornament to be placed at the top of tree 18. One or more switches may be provided to wire 13 to control some or all of the receptacles.

Figure 3:
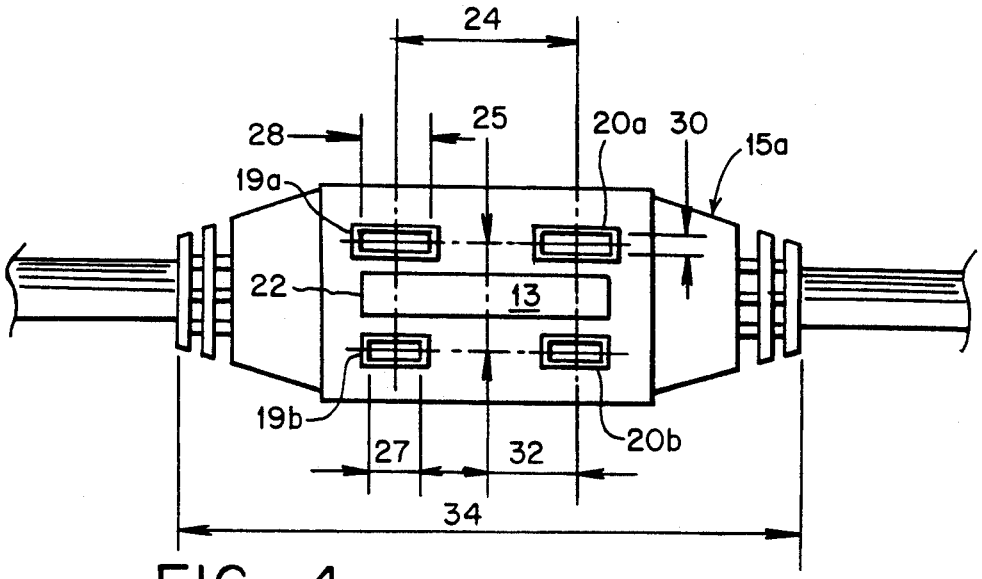
FIG. 3 is an enlarged top plan view of one of the receptacle blocks of the extension cord.

FIG. 3 is an enlarged view of receptacle block 15*a* showing two pairs of slots 19*a*, 19*b* and 20*a*, 20*b*. Wire 13 passes through receptacle block 15*a* as can be seen through a rectangular shaped window 22 which is centered on receptacle block 15*a*. A distance 24 between center lines of the two pairs of slots 19*a* and 20*a* or 19*b* and 20*b* is 0.870 inches, for example. The distance 25 between center line of two slots within a pair 19*a* and 19*b* or 20*a* and 20*b* is 0.5 inches. In the event that polarized slots are used, the smaller slots 19*b* and 20*b* have a length 27 of 0.280 inches and the wider slot 19*a* and 20*a* have a length 28 of 0.340 inches. All slots have a width 30 of 0.085 inches. The distance 32 from a center line of receptacle block 15*a* and a pair of slots 19 or 20 is 0.435 inches. The overall length 34 of receptacle block 15*a* is 3.070 inches.

Figure 4:
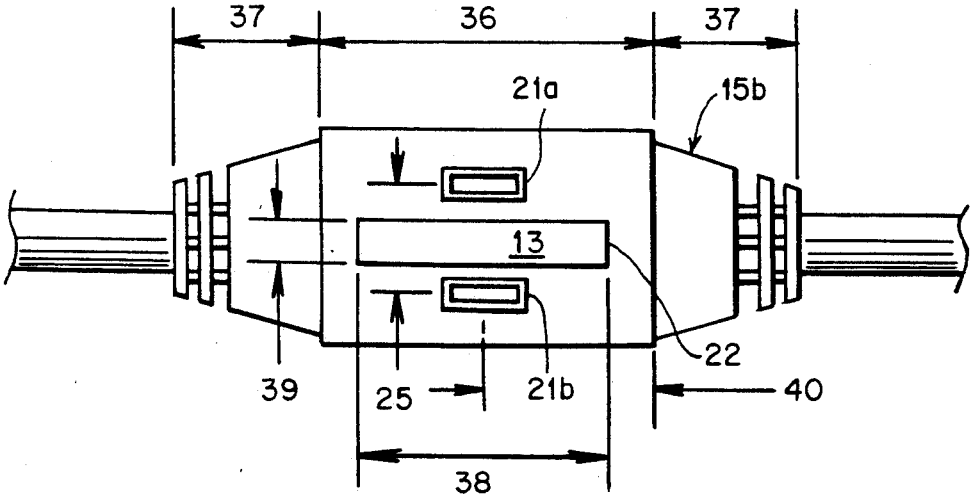
FIG. 4 is an enlarged bottom view of the receptacle block from FIG. 3.

FIG. 4 is an enlarged view of receptacle block 15*b* having a center length 36 of 1.590 inches and a length 37 of the end tapered portions of 0.74 inches. The length 38 of window 22 is 1.220 inches and the width 39 of window 22 is 0.20 inches. The width 25 between center lines of slots 21*a* and 21*b* is 0.5 inches. The length 40 between the center line of block 15*a* and the edge of the central portion is 0.810 inches.

Figure 5:
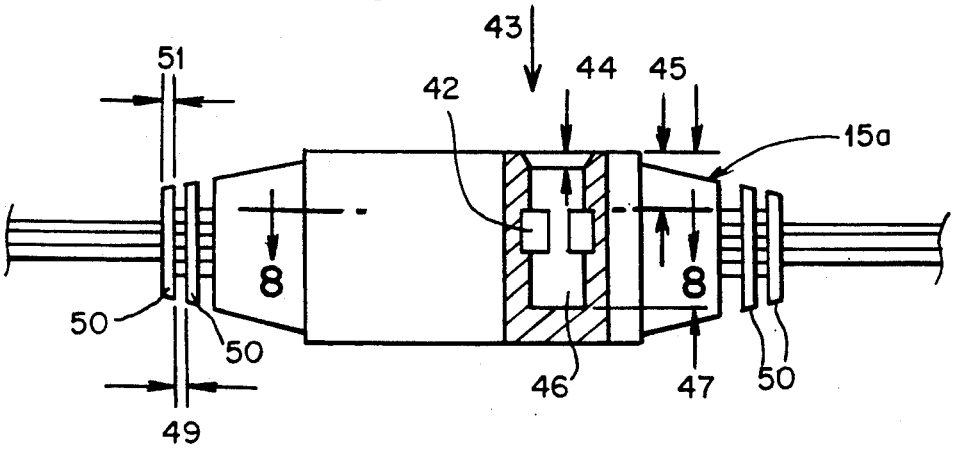
FIG. 5 is an enlarged side elevational view in part cross section of one of the receptacle blocks showing the terminal.

FIG. 5 shows one of two terminals 42 which is attached to one conductor of wire 13. A male plug would be inserted in direction 43 into slot 20*b*, for example, to contact terminal 42. The top layer 44 of receptacle block 15*a* has a thickness of 0.025 inches. The distance 45 between the top of block 15*a* and the top of terminal 42 is 0.240 inches. A gap 46 is formed in the vicinity of terminal 42. A distance 47 from the top of receptacle block 15*a* to the bottom of gap 46 is 0.720 inches. On either end of terminal block 15*a* are a pair of rectangular molded plates 50 having a thickness 51 of 0.070 inches and a distance 49 between adjacent plates of 0.055 inches.

Figure 6:
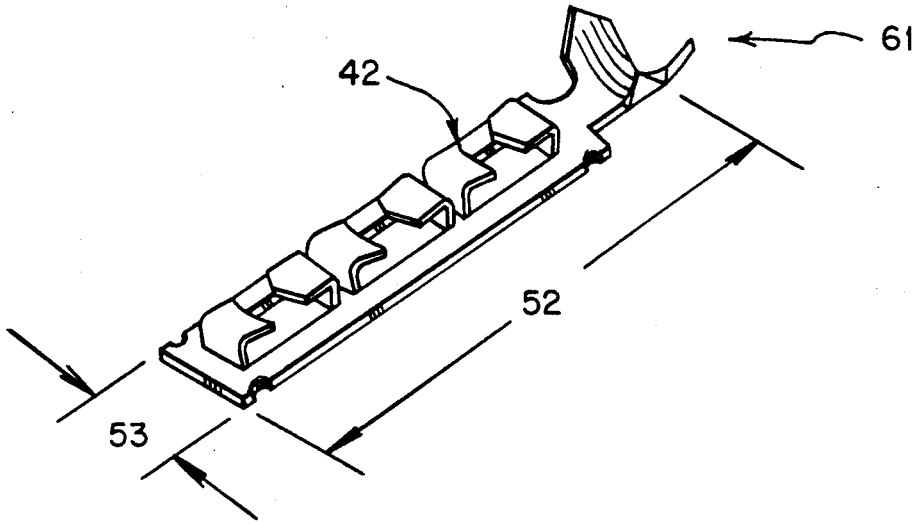
FIG. 6 is a perspective view of the terminal.
Figure 7:
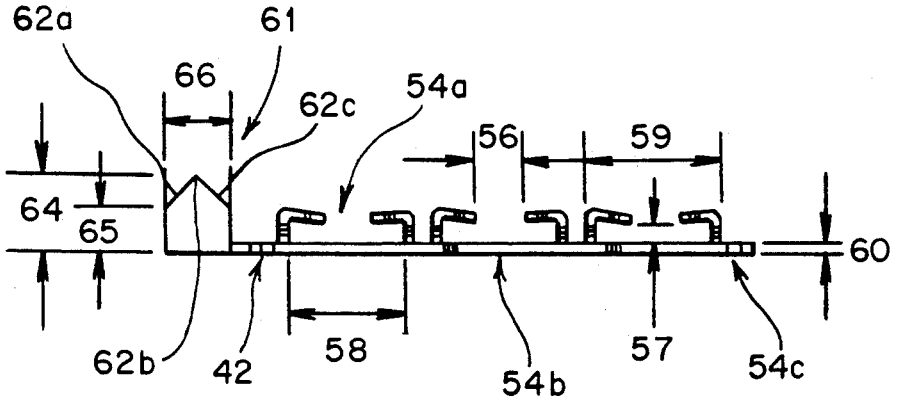
FIG. 7 is a side elevational view of the terminal.

FIGS. 6 and 7 show terminal 42 with an overall length 52 of 1.680 inches and an overall width 53 of 0.311 inches. Terminal block 42 has three pairs of L-shaped contacts 54*a*, 54*b*, and 54*c* which reside in slots 19*b*, 20*b* and 21*b*. Each contact of a pair is mounted a distance 56 of 0.140 inches from each other. The upper end of the contact is a distance 57 of 0.055 inches to the base. The inner distance 58 between contact bases is 0.340 inches and the outer distance 59 between contact bases is 0.380 inches. Terminal 42 has a thickness 60 of 0.020 inches.

On one end of terminal 42 is a crimp connector 61 having three pointed sections 62*a*, 62*b* and 62*c* which are crimped onto one conductor of wire 13. After crimping, the receptacle block is molded onto terminal 42 with wire 13 entering one side and exiting the other side, for example, with receptacle blocks 15*a* and 15*b*. Receptacle block 15*c* is a cord terminating device. The receptacle blocks are made from molded PVC, for example. The overall height 64 of points 62*a*, 62*b* and 62*c* is 0.130 inches. The distance 65 from the base of the points to the bottom of terminal 42 is 0.110 inches. A distance 66 between points 62*a* and 62*c* is 0.195 inches.

Figure 8:
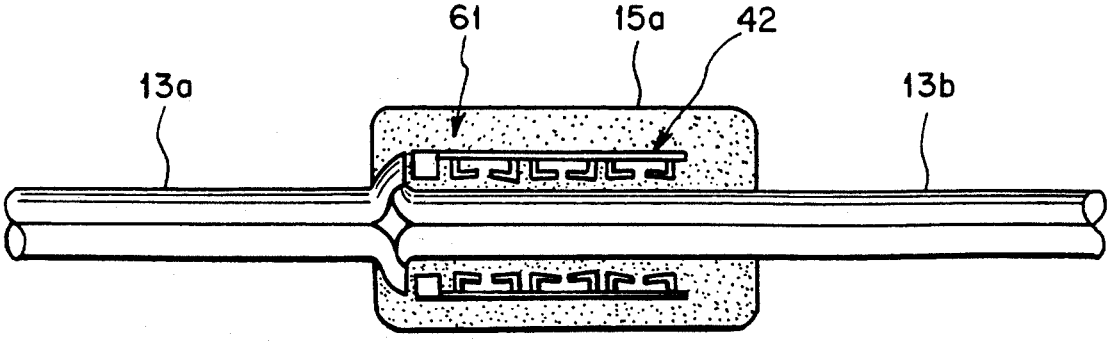
FIG. 8 is a cross-sectional view taken along the line 8—8 from FIG. 5.

FIG. 8 shows terminal 42 with crimp connector 61 attached to incoming wire 13*a* and outgoing wire 13*b*. Receptacle blocks 15*a* and 15*b* are of this type of construction. Receptacle block 15*c*, which is a terminating block, only has an incoming wire. Crimp connector 61 attaches wire 13*a* to wire 13*b* and then receptacle block 15*a* is molded around terminal 42 and wires 13*a* and 13*b* to hold them securely in place.

As can be appreciated, contacts 54*a* and 54*c* are accessible through the two slots 19*a* and 20*a* or 19*b* and 20*b* shown in receptacle block 15*a*. The remaining center contact 54*b* is accessible through third slots 21*a* or 21*b* which is located on block 15*b* (on the underside of block 15*a*). Each receptacle block includes two terminals 42, one for powering the shorter slots 19*a*, 20*a*, 21*a* and one for powering the longer slots 19*b*, 20*b*, 21*b*.

While only a single embodiment of the present invention has been shown and described, it is to be understood that many changes and modifications may be made thereunto without departing from the spirit and scope of the invention as defined in the appended claims.

What is claimed is:

1. An extension cord with multiple receptacles comprising:

an electric wire with a first end, a second end and a male plug coupled to said first end thereof;

a fuse coupled to said wire; and multiple receptacle blocks coupled to said wire at spaced intervals along said wire, one of said receptacle blocks being coupled to said second end of said wire, each of said receptacle blocks having several pairs of slots for receiving male plugs of items to be powered by the extension cord.

2. The extension cord according to claim 1, wherein said fuse is located between said male plug and said multiple receptacle blocks.

3. The extension cord according to claim 2, wherein said electric wire is a two conductor wire and said fuse is coupled to one of said conductors.

4. The extension cord according to claim 3, wherein said spaced intervals along said wire are equally spaced intervals.

5. The extension cord according to claim 4, wherein the extension cord comprises three receptacle blocks, each having three pairs of slots for receiving male plugs.

6. The extension cord according to claim 5, wherein said multiple receptacles are spaced to provide one receptacle at the top, middle and bottom of a Christmas tree.

7. The extension cord according to claim 6, wherein said electric wire passes through said multiple receptacle blocks, with said multiple receptacle blocks being molded onto said wire.

8. The extension cord according to claim 7, wherein said wire is an 18-gauge, two-conductor wire.

9. The extension cord according to claim 8, wherein said fuse has a maximum rating of 6 amps so that the extension cord can provide a total of 720 watts of power at 120 volts.

10. The extension cord according to claim 9, wherein said receptacle coupled to said second end of said wire includes a molded plastic loop for hanging the extension cord from the top of a Christmas tree.

11. The extension cord according to claim 10, wherein the extension cord further includes a switch coupled to said wire for switching the power to said multiple receptacle blocks on and off.

* * * * *